United States Patent [19]

Bonaschi

[11] Patent Number: 4,581,905

[45] Date of Patent: Apr. 15, 1986

[54] PROCESS AND WEAVING MACHINE TO PRODUCE PATTERNED FABRICS

[75] Inventor: Antonio Bonaschi, Cilavegna, Italy

[73] Assignee: Comez, S.p.A., Milan, Italy

[21] Appl. No.: 554,201

[22] Filed: Nov. 22, 1983

[30] Foreign Application Priority Data

May 13, 1983 [IT] Italy ..... 21104 A/83

[51] Int. Cl.[4] ..... D04B 27/00

[52] U.S. Cl. ..... 66/203

[58] Field of Search ..... 66/203, 204, 207, 214

[56] References Cited

U.S. PATENT DOCUMENTS

| | | | |
|---|---|---|---|
| 3,099,921 | 8/1963 | Liebrandt | 66/214 |
| 4,319,468 | 3/1982 | Kohl | 66/207 |
| 4,417,456 | 11/1983 | Bergmann et al. | 66/214 |

*Primary Examiner*—Ronald Feldbaum
*Assistant Examiner*—Mary A. Ellis
*Attorney, Agent, or Firm*—Laff, Whitesel, Conte & Saret

[57] ABSTRACT

The invention pertains to the technical field of knitting machines and it particularly relates to a process and a knitting machine to produce figured fabrics, for example with variegated inscriptions or patterns. The technical problem to solve is how to obtain, by means of completely automatized knitting machines, variegated inscriptions or patterns which neatly alternate on a fabric without interfering with the ground of the same.

The solution to this problem is achieved by a process particularly for looms in which warp and weft yarns are tied together by means of chain stitches and in which it is also provided the formation of variegated patterns by means of pattern threads supplied to the needles by oscillating pattern-making members the oscillation of which is controlled by a jacquard-like device, in said process each of the above mentioned pattern-making members being caused to oscillate astride of a single needle, while the pattern threads that must not be hooked are stretched and folded down on auxiliary attachments disposed adjacent the needles and then caused to disappear between the front and rear weft yarns of the fabric being formed.

12 Claims, 11 Drawing Figures

17
23
3
5

PROCESS AND WEAVING MACHINE TO PRODUCE PATTERNED FABRICS

FIELD AND BACKGROUND OF THE INVENTION

The present invention relates to a process and a knitting machine to produce figured fabrics, for example fabric with inscriptions or with intricate variegated patterns.

It is known that there are at present on the market rather complicated knitting machines which are substantially defined by a crochet loom associated with a jacquard or jacquard-like device. The latter can execute patterns across the warp yarns of the crochet loom.

The knitting machines of the kind mentioned above are generally efficient and are able to produce fabrics with intricate variegated patterns. However they have some limitations; particularly it is impossible to completely hide undesired pattern threads in the fabric being formed above all in specific areas of the fabric itself, with respect to the pattern to be obtained.

In fact, it is not possible to eliminate the formation of chains or variegated lines with reference to the adjacent patterns whether the pattern threads are lifted or not, which obviously disturbs and interrupts the uniformity of the fabric ground.

In these prior art knitting machines the pattern threads are supplied by tubular thread guides controlled by said jacquard device. Said tubular thread guides execute, for each work cycle, a substantially horizontal movement parallel to the needle-bar. The length of this movement is a multiple of the distance between two needles in succession. These tubular thread guides also execute vertical movements capable of alternately bringing the tubular thread guides from a position below said needles to a raised position with respect to the same.

Obviously such a situation affects the quality of fabrics thus obtained that can appear unsatisfactory as to the patterns executed therein.

OBJECTS

The technical task on which the present invention is based is therefore to eliminate the above mentioned drawbacks relating to the known art.

Within the scope of this technical task it is an important object of the present invention to provide a process and a knitting machine for performing said process, which can be readily achieved starting from the traditional pre-existing knitting machines.

A further important object of the invention is to provide a process and a knitting machine for performing said process, offering a great variety of embodiments so that they can be readily adapted to the different inherent requirements.

SUMMARY OF THE INVENTION

The technical task mentioned above as well as the above objects are attained by a process according to the invention to make figured fabrics, particularly for looms in which warp and weft yarns are tied together by means of chain stitches and in which also provides the formation of patterns by means of pattern threads supplied to the needles by oscillating pattern-making members, the oscillation of which is controlled by a jacquard-like device, said process being characterized in that the pattern threads that must not be hooked are stretched and caused to be folded down on auxiliary attachments disposed close to the needles, and are then caused to disappear between the fore and rear weft yarns of the fabric being formed.

Advantageously said process is achieved by a knitting machine of the kind comprising a crochet loom and a jackquard-like device supplying pattern threads through tubular thread guides cyclically oscillating close to the needles both in a horizontal direction parallel to a needle-bar and in a substantially vertical direction, at right angles to the bar itself and to said needles, said tubular thread guides taking a final lowered or raised position alternatively at each work cycle, said machine being characterized in that it comprises a plurality of auxiliary attachments disposed adjacent each needle close to the lines of development of said pattern threads when said tubular thread guides take said final raised position, said auxiliary attachments being shaped and disposed so that they can keep said pattern threads out of the areas of action of the respective needles.

Further features and advantages will appear more evident from the description of a preferred embodiment of the invention given hereinafter by way of example only, with reference to the accompanying drawings, in which:

DESCRIPTION OF THE PREFERRED EMBODIMENT

Figure 3:
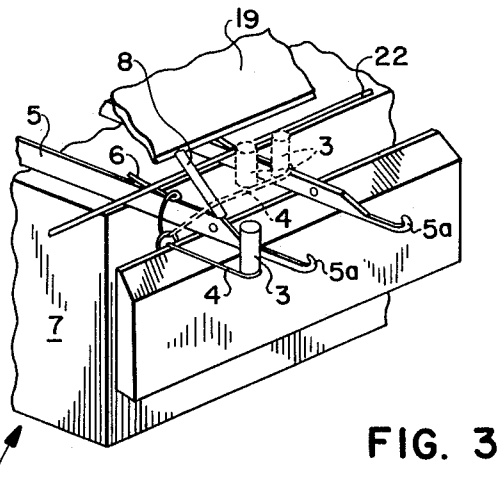
FIGS. 2 and 3 are perspective views of a detail of the machine shown in FIG. 1 during two different operative steps.
Figure 2:
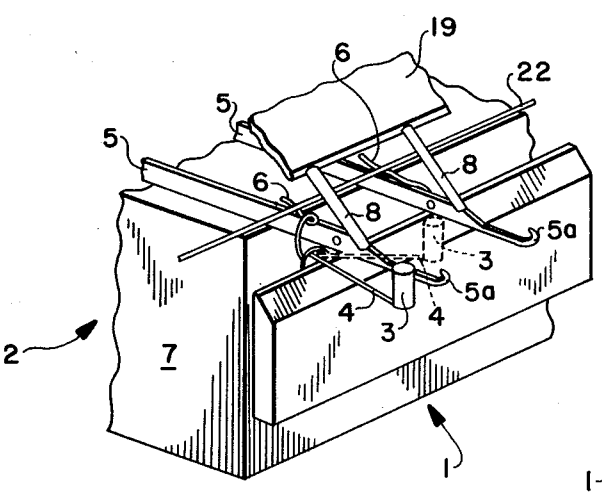
Figures 4A, 4B, 4C, 4D, 5A, 5B, 5C, 5D:
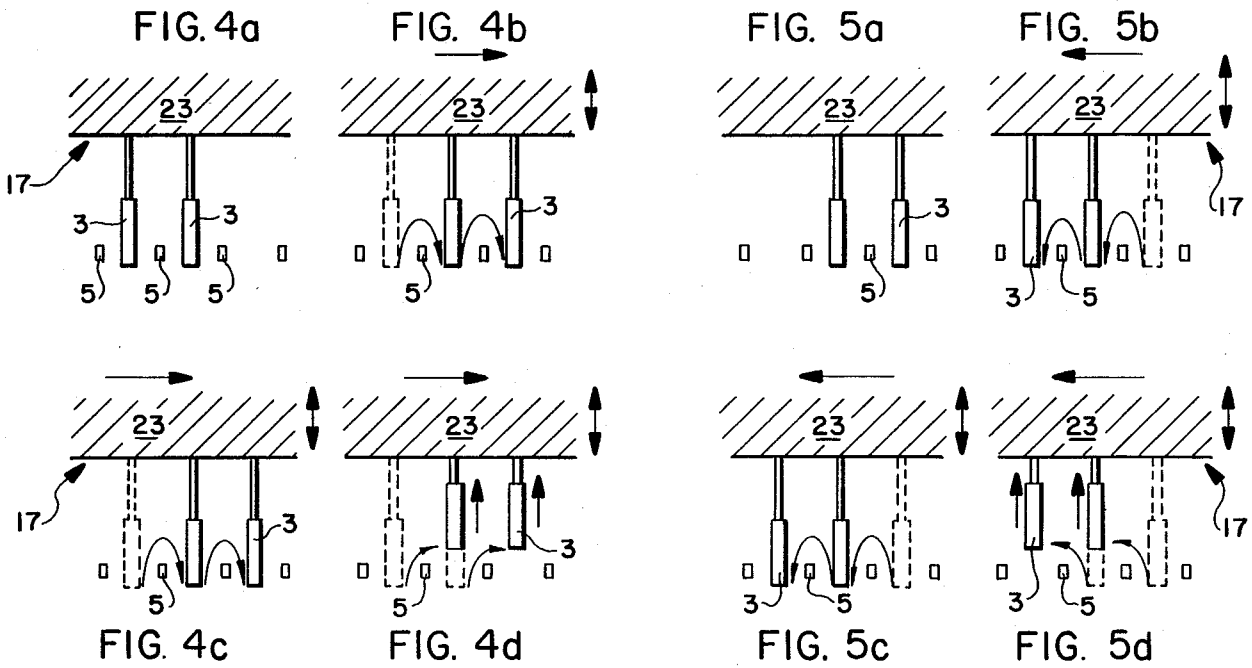
FIGS. 4*a* to 4*d* show an alternate preferred embodiment concerning the positioning and path of the present invention.
FIGS. 5*a* to 5*d* show the invention of FIGS. 4*a*–4*d* operating in an opposite direction.

The process according to the invention is particularly disclosed in FIGS. 2 and 3.

According to this process, a particular step in which the pattern threads are excluded from the action of needles is provided, reference being especially made to a machine 1 in which a loom 2 of the crochet type acts in cooperation with a jacquard-like device provided at its end with pattern-making members consisting for example of tubular thread guides 3 for pattern threads identified at 4. The pattern threads 4 are supplied to needles 5 provided with a tongue 6 and are combined with warp and weft yarns.

The pattern-making members or tubular thread guides 3 are caused to oscillate, each extending across a single needle, in a direction parallel to a needle bar or a front grooved bar 7. Furthermore, the tubular thread guides 3 are alternatively raised or lowered according if it is necessary to exclude the pattern threads 4 from the action of needles 5 or not.

In case of lifting of the tubular thread guides 3 in order to exclude the pattern threads 4 from the action of needles 5, the operation is as shown in FIG. 3: pattern threads 4 are stretched and caused to be folded on auxiliary attachments 8 disposed adjacent needles 5, so that said pattern threads are kept out of the area of action of all needles 5.

The final lifted position of the tubular thread guides 3 is then reached, according to a technical solution of the present invention, starting from an initial position already raised within a certain limit with respect to needles 5; however this raised position allows the pattern threads to be normally catched when the tubular thread guides 3 are not further raised, as shown in FIG. 2.

It is also provided that the pattern threads that are thus excluded from the action of needles remain inside the fabric being formed, being therefore invisible between the front and rear weft yarns.

The process according to the invention is performed by a new and original knitting machine that will be hereinafter described reference being made to all figures.

The weaving machine according to the invention, generally indicated at 1, consists of the following members already disclosed with reference to the process performed by same: a crochet loom 2, tubular thread guides 3 disposed at the end of a jacquard device 9, needles 5 projecting from a needle-bar 10 and provided with a tongue 6, a front grooved bar 7 and auxiliary attachments 8 suitable to engage pattern threads 4.

Figure 1:
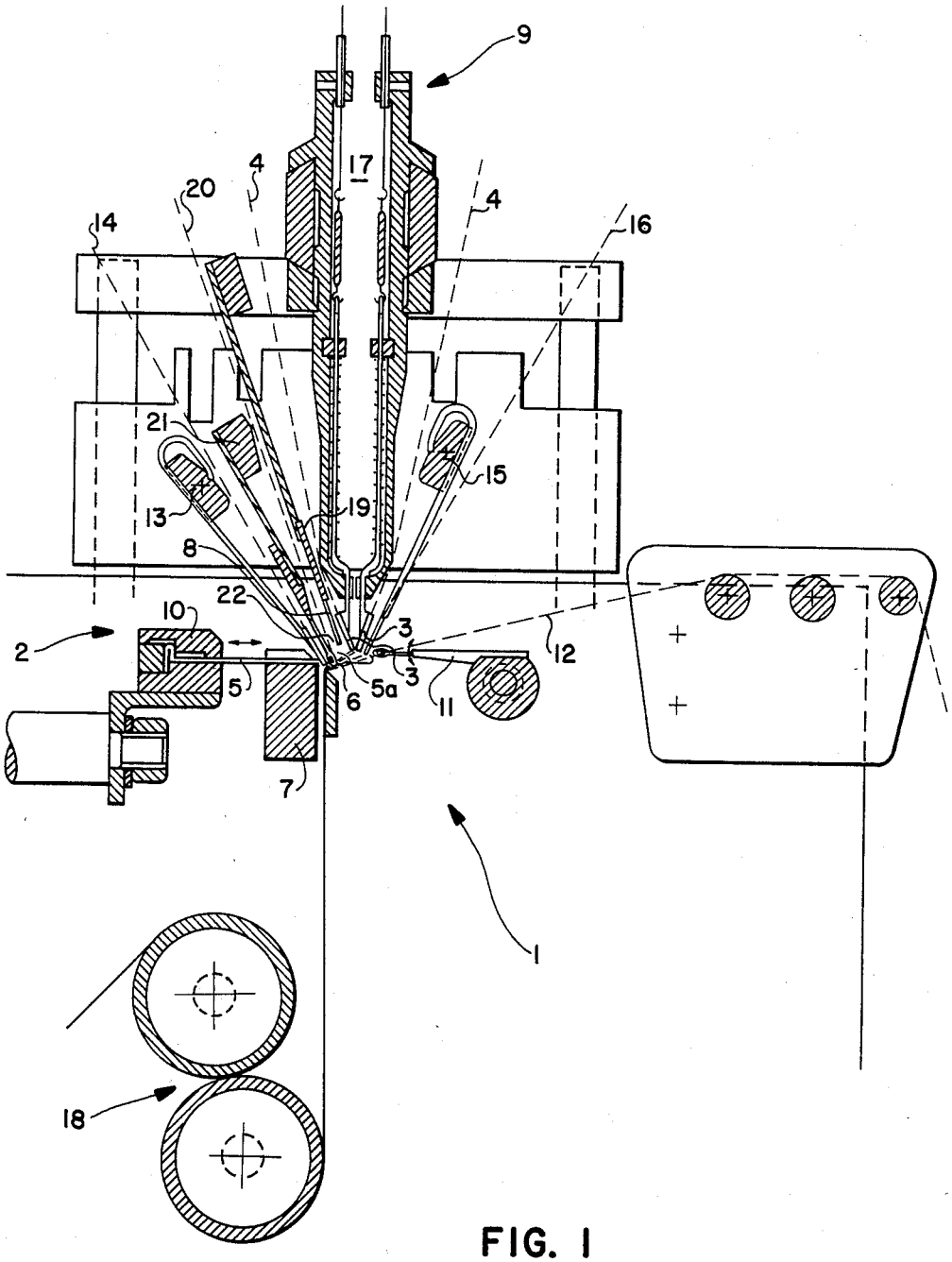
FIG. 1 is a diagrammatic view of the knitting machine according to the invention.

Besides these members, the machine according to the invention is also provided with further members that are prevalently known in themselves. For example, a warp yarn guide bar 11 for supplying warp yarns 12, an under-yarn guide bar 13 for supplying under-weft yarn 14, a front-yarn guide bar 15 for supplying front-weft yarn 16 as well as a control device 17 for the tubular thread guides 3 suitable to raise the same and movable in conjunction with an oscillating horizontal crosspiece that oscillates at each work cycle of the machine. FIG. 1 also shows rollers 18 to wind up the formed fabric.

According to the invention, the auxiliary attachments 8 that, in a novel way, are disposed adjacent each needle 5 (in the embodiment said attachments 8 are disposed upwardly and coplanar with respect to needles 5, with a space therebetween necessary and sufficient to allow the possible passing of the pattern thread when the tubular thread guides 3 are in their lowered position) are defined by oblique projections converging towards the needles 5, particularly towards the hooks 5*a* of the same. Said auxiliary attachments or projections 8 project from a projection carrier bar 19 interposed, in a novel way and as shown in FIG. 1, between the control device 17 of the tubular thread guides 3 and the under-yarn guide bar 13. Preferably, when rubber thread 20 has to be fed, the projection carrier bar 19 is interposed between the control device 17 and the rubber thread guide bar 21, the latter being closely adjacent the under-yarn guide bar 13.

Projections 8 can have various lengths and can take different positions with respect to the planes defined by needle hooks 5*a*. A technical solution in which, as shown in FIGS. 2 and 3, projections 8 develop each in a plane of a hook 5*a* of needles 5 is at present preferred.

FIGS. 1 to 3 show that the machine of the invention is also provided with a locking member 22 for the tongues 6 which advantageously consists of a wire or tie rod stretched transversely to needles 5 and engaging tongues 6 so that the latter are held in an opening position when needles 5 are in a substantially forward position.

A particularly new feature of the machine according to the invention consists in that the control device 17 of the tubular thread guides 3 is so shaped, as to its sizes and its connections with the control members controlling its movements, that to a substantially horizontal movement equal to the distance between two needles in succession of a specific crosspiece supporting all said tubular thread guides 3, corresponds a vertical movement of the same tubular thread guides 3, which movement preferably starts from a position already raised within a certain limit with respect to needles 5. In fact, it has been surprisingly found that even if the tubular thread guides 3 are arranged at a slightly higher level than needles 5, pattern threads 4 can be in any way catched by hooks 5*a* of needles 5 if the tubular thread guides 3 are not further lifted. This particular feature is particularly disclosed in FIG. 2 where it is possible to see that the needles can catch thread 4, being the same in any case downwardly inclined as it is connected to the loops already made and that are going to be discharged from needles 5. The technical solution to keep the tubular thread guides 3 always above needles 5 gives the advantage that it is possible to move the tubular thread guides themselves freely, no problem arising as to interfering of same with needles 5; therefore they can execute short and perfectly synchronized movements.

However it is clear that the starting position of tubular thread guides 3 can be different. Particularly, FIGS. 4*a* to 4*d* and 5*a* to 5*d* show tubular thread guides 3 moving from a starting position that is below the plane of needles 5. In this case the tubular thread guides 3 are supported, in a novel way, by a tubular guide carrier crosspiece 23 (quite similar to the one mentione above) which not only moves parallelly to the plane of needles, but also at right angles to the same. The tubular thread guides 3 are then raised and lowered as in the previous case and when raised they tend to wind the pattern threads about projections 8, as shown in FIG. 3.

The invention reaches important advantages. In fact, thanks to the process and the machine of the invention it is possible to produce faultless fabrics as to the homogeneity and uniformity of the ground on which patterns are made. The excluded pattern threads are completely hidden between the front and rear weft yarns of the fabric being formed.

In addition, the process and the machine according to the invention can be achieved starting from known machines, by means of comparatively easy adaptations.

The invention thus performed is susceptible of various modifications and variations, all within the scope of the invention itself.

For example, the above mentioned additional attachments can have different shapes and be differently positioned close to the needles and the position of the tubular thread guides can be selected within rather wide limits.

Furthermore, all details can be replaced by technically equivalent members.

Practically the materials used, the shapes and sizes can be whatever, according to the particular requirements.

What is claimed is:

1. A process for producing patterned fabrics with a knitting machine wherein warp, front weft and rear weft yarns are tied together by chain stitches comprising feeding pattern threads to oscillating pattern-making members, setting the oscillating pattern making members to selectively supply pattern threads to knitting needles for the pattern threads that are to be hooked, and selectively supplying said pattern threads to auxiliary attachments for the pattern threads not being hooked by said needles and said pattern threads which are not hooked by said needles being placed between the front and rear weft yarns.

2. A process according to claim 1, wherein, each of said pattern-making members oscillates astride of a single needle.

3. A process according to claim 1 wherein each of said pattern-making members oscillates at right angles to a horizontal plane of said needles, with the oscillation starting from a position above the said horizontal plane.

4. A process according to claim 1, wherein each of said pattern-making members oscillates at right angles to a horizontal plane of said needles, in relationship with a bar which itself is suitable to lift said pattern-making members.

5. A knitting apparatus for patterned fabrics, comprising, a plurality of needles, tubular thread guides, a jacquard-like device for supplying pattern threads through said tubular thread guides, a needle bar, means to cyclically oscillating said tubular thread guides close to the needles both in a horizontal direction parallel to said needle-bar and in a substantially vertical direction, at right angles to said needle-bar and the said needles, said tubular thread guides being positioned in a final lowered or raised position alternatively at each work cycle comprises a plurality of auxiliary attachments disposed adjacent each needle, said auxiliary attachments being positioned to receive pattern threads and to maintain said pattern threads out of contact with said needles, means to selectively feed patterns threads to either said auxiliary attachments and said needles, means to tie warp, front weft and rear weft yarns together by chain stitches and means to place the pattern threads on said auxiliary attachments between the front and rear weft yarns.

6. A machine according to claim 5, which includes a control device for the tubular thread guides, said control device being shaped to impart horizontal oscillations to the tubular thread guides and said oscillations being in an amplitude equal to the distance between two needles in succession.

7. A machine according to claim 5 wherein, said needles include tongues and having a locking means for locking the tongues of said needles in an opened position when the needles are in a substantially forward position.

8. A machine according to claim 5, wherein said locking means is a tie rod stretched transversely to the needles.

9. A machine according to claim 5, wherein said auxiliary attachments consist of projections obliquely converging towards said needles and substantially positioned in planes defined by hooks on said needles.

10. A machine according to claim 5 which includes an under yarn guide bar, a control device for the tubular thread guides said projections are supported by a projection carrier bar disposed between an under-yarn bar and a control device for said tubular thread guides and said projections being supported by said projections carrier bar.

11. A machine according to claim 5 wherein said control device supports aid tubular thread guides always in raised position with respect to the needle plane.

12. A machine according to claim 5 wherein said control device comprises a tubular guide carrier bar vertically movable in relationship with vertical movement of the tubular thread guides themselves.

* * * * *